US008628361B2

(12) United States Patent
Kato

(10) Patent No.: US 8,628,361 B2
(45) Date of Patent: Jan. 14, 2014

(54) PRESS-FIT CONNECTOR HAVING A PENETRATION APERTURE

(75) Inventor: Keisuke Kato, Tokyo (JP)

(73) Assignee: NEC Corporation, Tokyo (JP)

( * ) Notice: Subject to any disclaimer, the term of this patent is extended or adjusted under 35 U.S.C. 154(b) by 69 days.

(21) Appl. No.: 13/346,239

(22) Filed: Jan. 9, 2012

(65) Prior Publication Data

US 2012/0252284 A1 Oct. 4, 2012

(30) Foreign Application Priority Data

Mar. 31, 2011 (JP) ..... 2011-078959

(51) Int. Cl.
*H01R 13/42* (2006.01)

(52) U.S. Cl.
USPC ..... 439/751; 439/82

(58) Field of Classification Search
USPC ..... 439/884, 751, 82, 866, 81, 572, 867
See application file for complete search history.

(56) References Cited

U.S. PATENT DOCUMENTS

| | | | | |
|---|---|---|---|---|
| 7,017,259 | B2 * | 3/2006 | Aoki | 29/739 |
| 7,037,146 | B2 * | 5/2006 | Nakamura | 439/751 |
| 7,361,031 | B2 * | 4/2008 | Matsumura | 439/82 |
| 2001/0014014 | A1 | 8/2001 | Hiramatsu | |
| 2003/0049972 | A1 * | 3/2003 | Aoki | 439/751 |
| 2011/0192641 | A1 | 8/2011 | Goto | |

FOREIGN PATENT DOCUMENTS

| | | |
|---|---|---|
| JP | 6-349539 | 12/1994 |
| JP | 2001-148271 | 5/2001 |
| JP | 2001-230555 | 8/2001 |
| JP | 3842050 | 11/2006 |
| JP | 2010-062294 | 3/2010 |
| JP | 2011-9072 | 1/2011 |

OTHER PUBLICATIONS

Office Action mailed Jan. 29, 2013 by the Japanese Patent Office in Japanese Application No. 2011-078959 with partial English translation.

* cited by examiner

*Primary Examiner* — Hae Moon Hyeon
(74) *Attorney, Agent, or Firm* — Young & Thompson

(57) ABSTRACT

A press-fit connector in which the presence or absence of buckling of a press-fit pin can be confirmed by visual observation, when the press-fit pin is inserted by pressure into a through hole of a circuit board. The press-fit connector includes a press-fit section which holds a press-fit pin, and a connector section which can be installed on the press-fit section and which has a connecting pin that can be connected to the press-fit pin when the connector section is installed on the press-fit section. A penetration aperture for confirming buckling of the press-fit pin is provided in the press-fit section. The penetration aperture is formed in a circular shape surrounding the press-fit pin.

9 Claims, 7 Drawing Sheets

PRESS-FIT CONNECTOR HAVING A PENETRATION APERTURE

CROSS-REFERENCES

Background

The present invention relates to a press-fit connector.

In electronic equipment such as computers, connectors based on a press-fit system (pressure fitting system) are used widely as connectors for connecting a circuit board with a so-called back plane (see Patent Publication JP-A-2001-148271, Patent Publication JP-A-2010-062294 and U.S. Pat. No. 3,842,050). For example, as shown in FIG. 5, a connector 100 based on this system has a press-fit pin 101 which passes through the interior of the connector and projects downwards, and when installing the connector 100 on a circuit board A, the press-fit pin 101 is inserted under pressure into a through hole 102 in the circuit board A, by a machine. In so doing, the press-fit pin 101 engages with the inner sides of the through hole 102 due the elastic properties thereof.

Conventionally, in the case of a press-fit system connector, there are cases where, during the pressure insertion of the press-fit pin 101, the press-fit pin 101 does not enter accurately into the through hole 102 and buckles. Therefore, as shown in FIG. 6, after press-fitting, the rear surface of the circuit board A is observed visually to check whether the press-fit pin 101 has buckled, by seeing whether or not the front end of the press-fit pin 101 is projecting from the rear surface.

However, the length of press-fit pins 101 has been shortened in order to increase the speed of transmitted signals, and hence there are cases where the front end of the press-fit pin 101 does not project from the rear surface of the circuit board A after pressure insertion, as shown in FIG. 7, and in such cases, it is not possible to confirm whether or not the pin has buckled from a visual observation.

In post-processing after press-fitting, an electrical connection inspection between the press-fit pin and the circuit board is carried out, but if an electrical connection defect due to buckling is detected in this inspection, then it is necessary to return to the pressure insertion step for the press-fit pin and to carry out the manufacturing step again, and therefore production efficiency declines. Furthermore, there may be an electrical connection even when the pin has buckled, and therefore it is not possible to accurately detect buckling by an electrical connection inspection.

SUMMARY

The present invention was devised in view of these points, an object thereof being to provide a press-fit connector which is capable of confirming the presence or absence of buckling of a press-fit pin by visual observation, when a press-fit pin is inserted by pressure into a through hole of a circuit board.

The present invention which achieves this object is a press-fit connector having a press-fit pin which is inserted by pressure into a through hole of a circuit board, including: a press-fit section which holds the press-fit pin; and a connector section which can be installed on the press-fit section and which has a connection pin that can be connected to the press-fit pin when the connector section is installed on the press-fit section, wherein a penetration aperture for confirming buckling of the press-fit pin is provided in the press-fit section.

According to the present invention, it is possible to confirm the presence or absence of buckling of a press-fit pin by visual observation, by means of the penetration aperture which is provided in the press-fit section.

According to the present invention, since the presence or absence of buckling of a press-fit pin can be confirmed by visual observation, then it is possible to improve the manufacturing efficiency, because buckling is never detected in connection inspection in a subsequent step, for example, and there is no need to return to the manufacturing step. Furthermore, since buckling can be detected accurately, then it is possible to reduce the occurrence of defective points.

DETAILED DESCRIPTION

Figure 1:
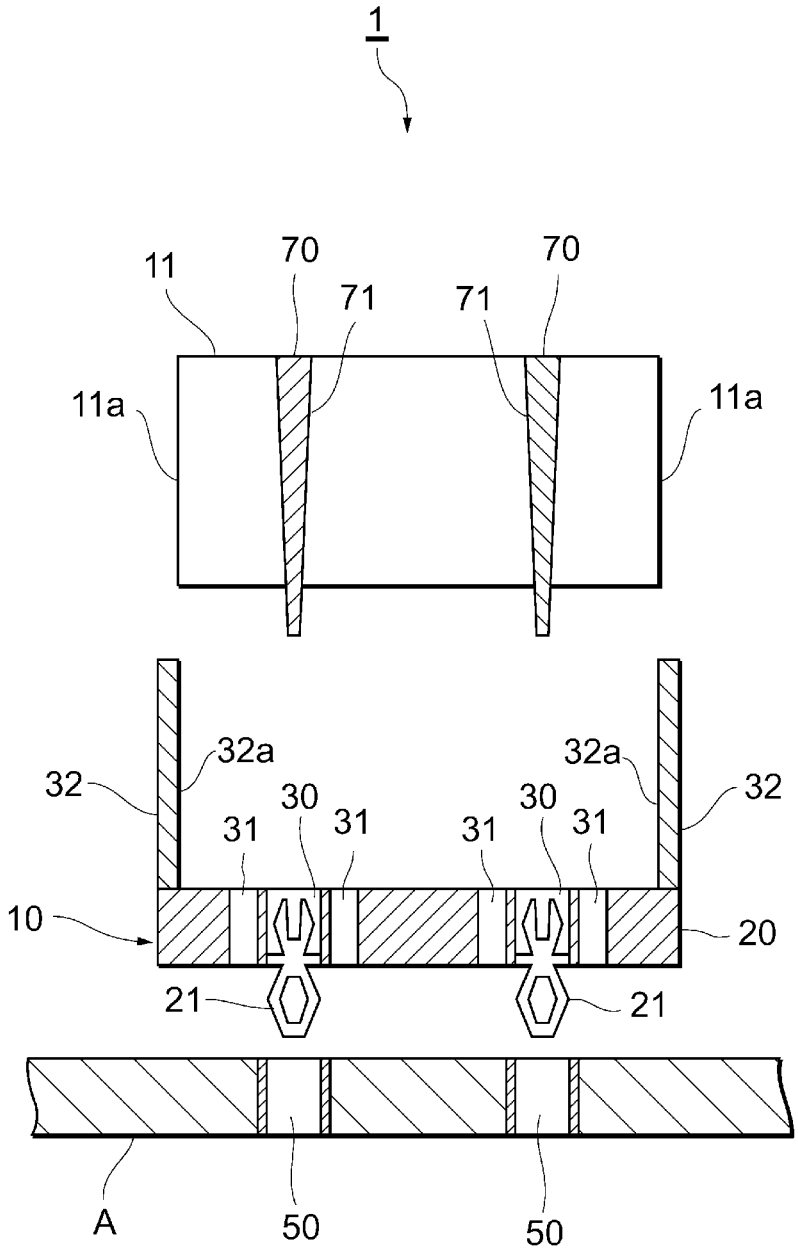
FIG. 1 is an illustrative diagram showing a schematic view of the composition of a press-fit connector.

Below, a preferred embodiment of the present invention is described with reference to the drawings. FIG. 1 is an illustrative diagram showing a schematic view of the composition of a press-fit connector 1 relating to the present embodiment.

As shown in FIG. 1, the press-fit connector 1 has a press-fit section 10 and a connector section 11.

Figure 2:
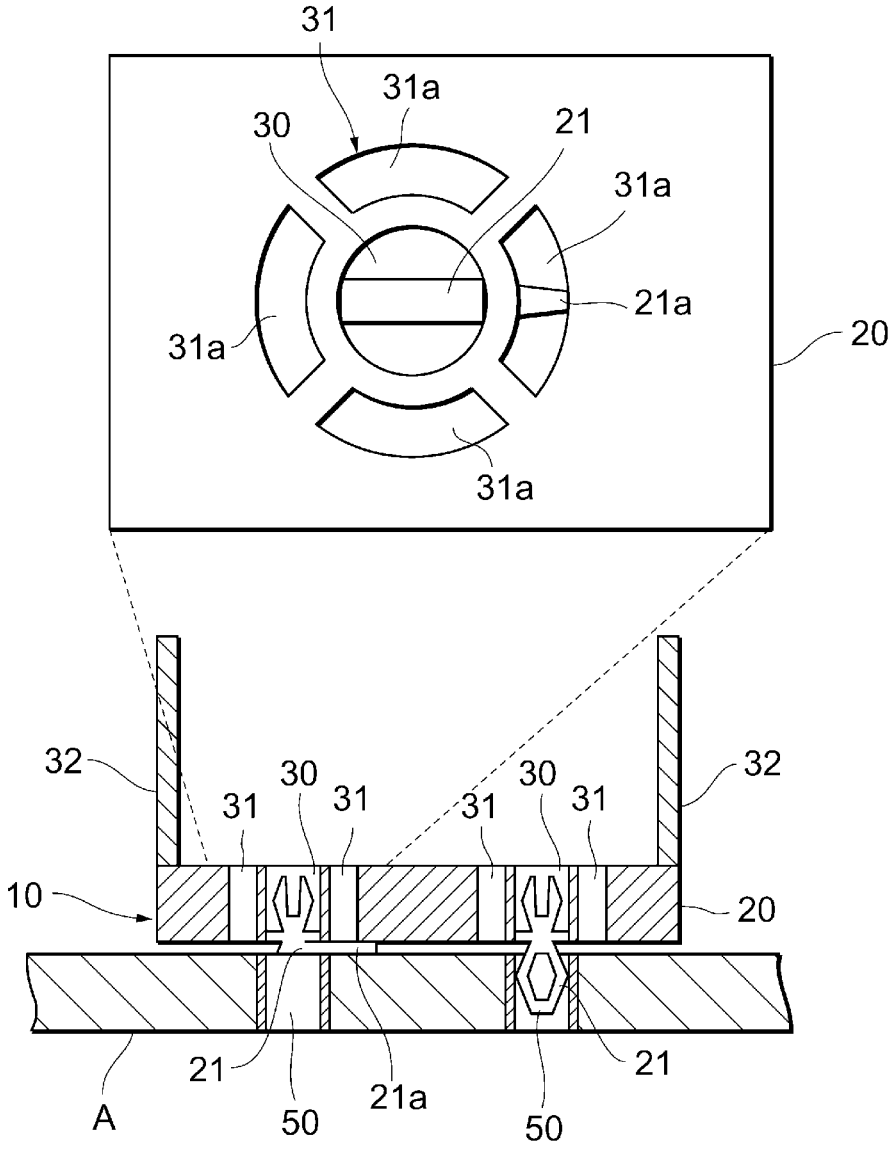
FIG. 2 is an illustrative diagram showing a state of a press-fit connector when buckling has occurred.

The press-fit section 10 has a main body section 20 and a plurality of press-fit pins 21 which are held on the main body section 20. The main body section 20 is formed in a flat plate shape, for example, and has a plurality of penetration holes 30 passing therethrough in the thickness direction, in which the press-fit pins 21 are held. The penetration holes 30 are provided at positions corresponding to through holes 50 in the circuit board A. Furthermore, the main body section 20 has penetration apertures 31 passing in the thickness direction about the periphery of the penetration holes 30. The penetration apertures 31 are formed in a circular shape surrounding the penetration holes 30 as shown in FIG. 2, for example. For instance, each penetration aperture 31 is constituted by a plurality of circular arc sections 31*a* centered on the corresponding penetration hole 30, and surrounds the periphery of the penetration hole 30.

Furthermore, as shown in FIG. 1, the main body section 20 has a holder 32 forming a holding section which extends upwards from the outer circumferential portion thereof. Recess sections 32*a* extending in the up/down direction are formed in the inner surface of the holder 32. The recess sections 32*a* interlock with projecting sections 11*a* formed in the outer circumferential surface of the connection section 11, whereby the connector section 11 can be inserted from above and fixed into the press-fit section 10. Provided that interlocking is possible, a projecting section may be provided on the holder 32 side and a recess section may be provided in the connector section 11.

Figure 3:
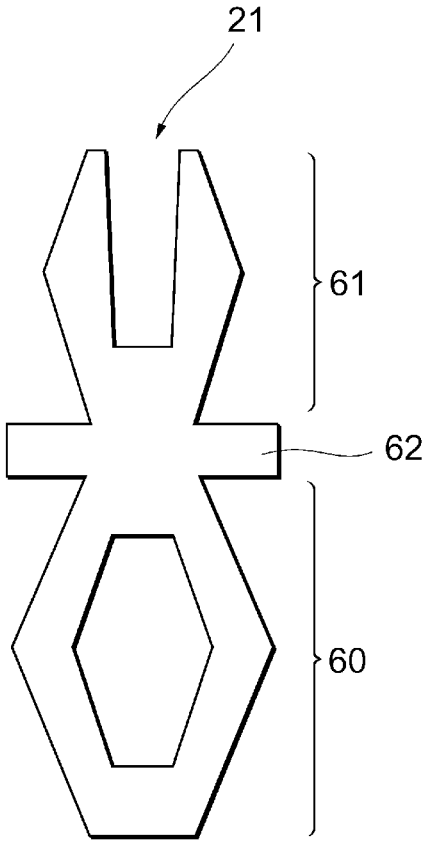
FIG. 3 is an illustrative diagram showing a composition of a press-fit pin.

FIG. 3 shows a composition of a press-fit pin 21. The press-fit pin 21 comprises a pressure insertion section 60 which is inserted by pressure into a through hole 50 in the circuit board A, a connecting section (receiving section) 61 for connecting with a connection pin 71 (described hereinafter) of the connector section 11, and a fixing section 62 to be fixed to the main body section 20. The pressure insertion section 60 is formed in the lower part of the press-fit pin 21, the connecting section 61, in the upper part thereof, and the fixing section 62 in the middle part between the pressure insertion section 60 and the connecting section 61.

Figure 4:
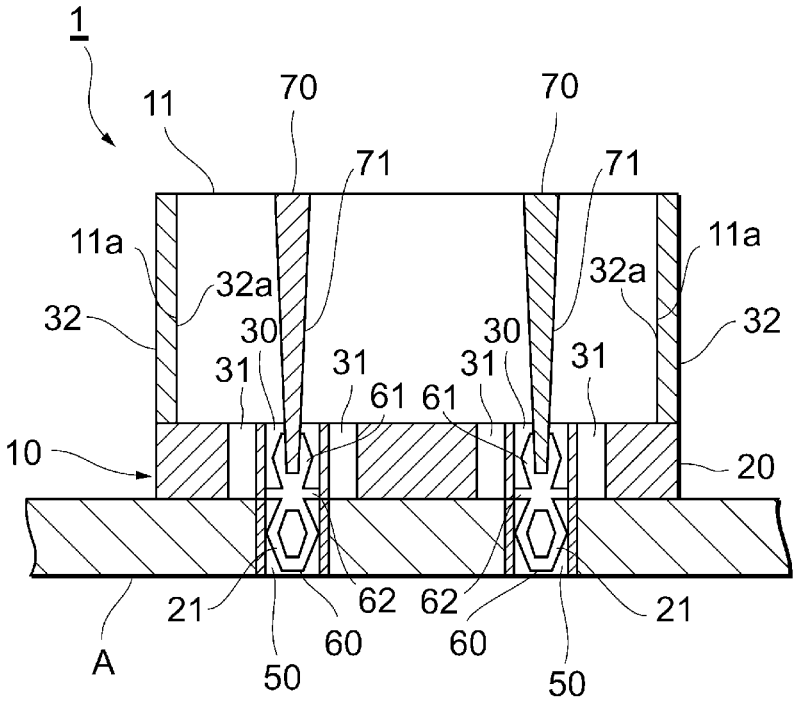
FIG. 4 is an illustrative diagram showing a state of a press-fit connector during press-fitting.
Figure 5:
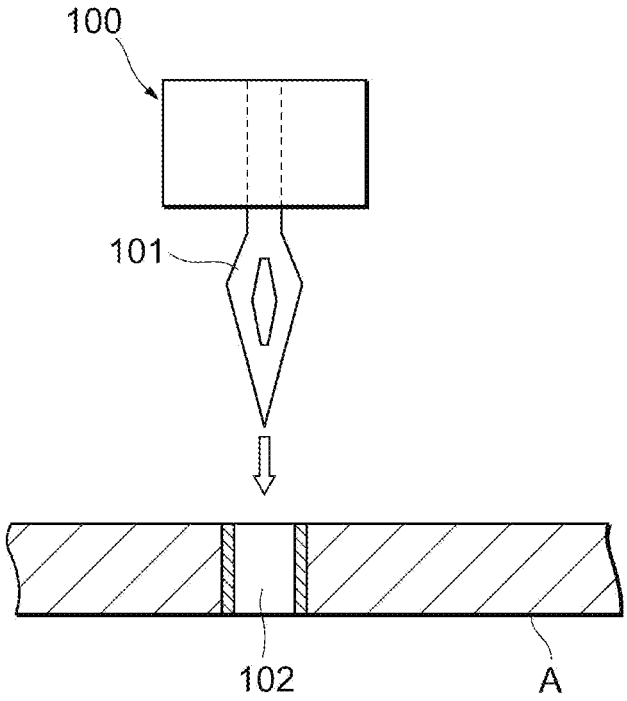
Fig. 5 PRIOR ART
FIG. 5 is an illustrative diagram showing a schematic view of the composition of a connector before improvement.
Figure 6:
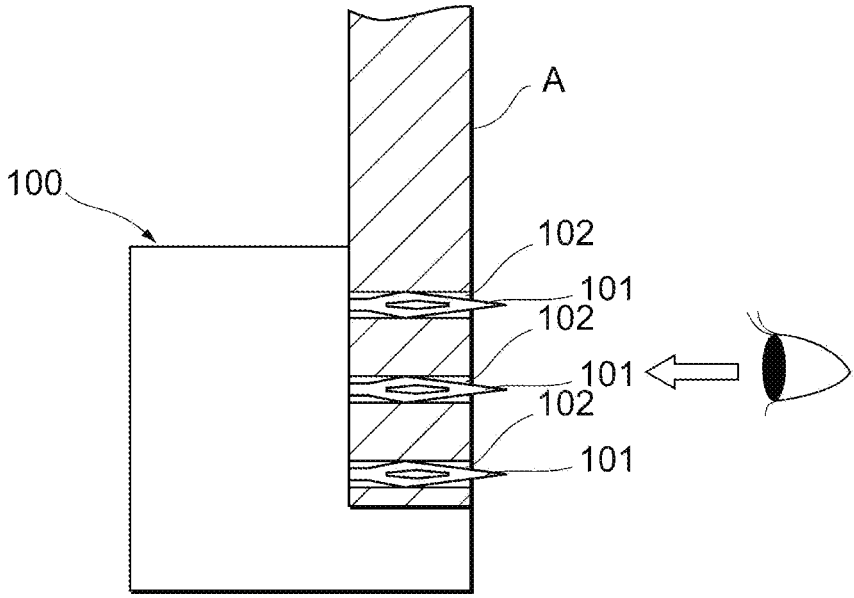
Fig. 6 PRIOR ART
FIG. 6 is an illustrative diagram showing a state of visual confirmation of buckling according to the prior art.
Figure 7:
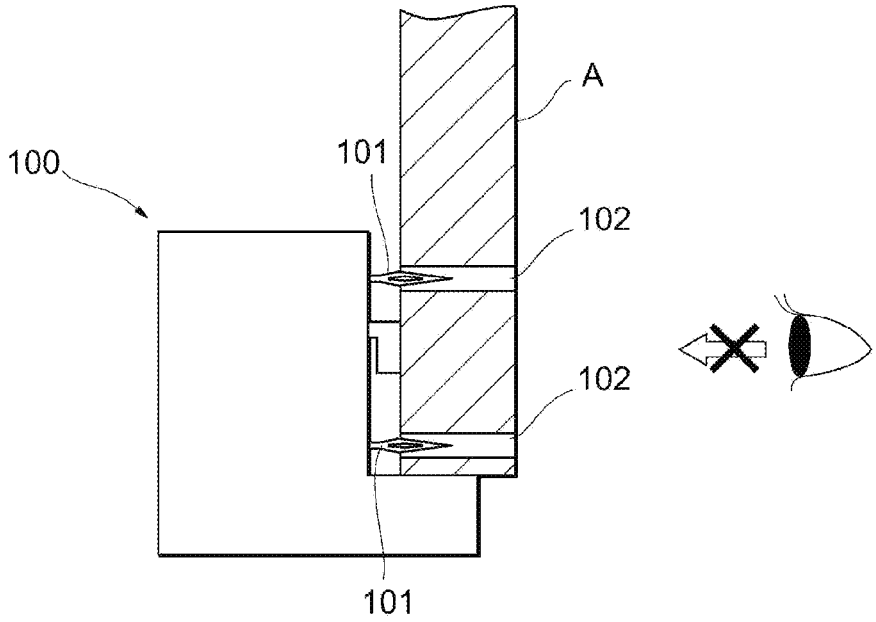
Fig. 7 PRIOR ART
FIG. 7 is an illustrative diagram showing a state of visual confirmation of buckling of a short press-fit pin.

The entire pressure insertion section 60 is formed to be slightly larger than the diameter of the through holes 50, has a hole formed in the centre thereof, and has elastic properties in its entirety. As shown in FIG. 4, when the pressure insertion section 60 is inserted by pressure into a through hole 50, the pressure insertion section 60 is fitted inside the through hole 50 due to the elastic properties thereof. The upper part, for example, of the connecting section 61 is formed into two prongs, which can grip and connect with the connection pin 71. The fixing section 62 is formed to be slightly larger than the diameter of the penetration hole 30, for example, and is fixed to the main body section 20 by being inserted by pressure into the penetration hole 30.

The connector section 11 is formed in a block shape, for example, which is accommodated inside the holder 32 of the press-fit unit 10, as shown in FIG. 1. A plurality of penetration holes 70 passing through the connector section 11 in the thickness direction are formed so as to correspond to the press-fit pins 21. A plurality of electrically conductive connector pins 71 are inserted into the penetration holes 70. The connector pins 71 project downwards from the connector section 11 and the lower ends of the connector pins 71 are held and coupled to the connector sections 61 of the press-fit pins 21 when the connector section 11 is installed in the press-fit section 10. The upper end sides of the connector pins 71 are connectable to a substrate, which is known as a back plane.

Next, the action of a press-fit connector 1 which is composed as above will be explained. In an electronic device manufacturing process, the press-fit pins 21 of the press-fit section 10 are inserted by pressure into the through holes 50 in the circuit board A, as shown in FIG. 2, by means of a machine. Thereupon, the presence or absence of buckling of the press-fit pins 21 is observed visually via the penetration apertures 31 from the upper surface side of the press-fit section 10. In this case, if there is buckling, then the buckled portion 21 a is visible via a penetration aperture 31 and the buckling can be confirmed.

After confirming the presence or absence of buckling of the press-fit pins 21, if there is no buckling, then as shown in FIG. 4, the connector section 11 is installed on the upper surface of the press-fit section 10. In this case, the connector section 11 is gripped by the holder 32 and fixed to the press-fit section 10. Furthermore, each of the connecting pins 71 is connected to a corresponding press-fit pin 21. If there is buckling, then after replacing the buckled press-fit pin 21, the press-fit pins 21 of the press-fit section 10 are inserted by pressure into the through holes 50 of the circuit board A again by machine.

According to the embodiment described above, since penetration apertures 31 are formed in the press-fit section 10, then it is possible to confirm the presence or absence of buckling of the press-fit pins 21 by visual observation. Furthermore, since the press-fit connector 1 is divided into a press-fit section 10 and a connector section 11, then it is possible to make the press-fit section 10 where the penetration apertures 31 are formed thin, and confirmation of buckling via the penetration apertures 31 becomes easy to carry out.

Since the penetration apertures 31 are formed in a circular shape surrounding the press-fit pins 21, then it is possible to confirm buckling in any direction more reliably.

Since the press-fit section 10 has a holder 32 which holds the connector section 11, then it is possible to fit the connector section 11 appropriately to the press-fit section 10.

Preferred embodiments of the present invention were described above with reference to the accompanying drawings, but the present invention is not limited to this example. Evidently, a person skilled in the art would be able to arrive at various modifications or amendments within the scope of the ideas described in the claims, and it is understood that such modifications or amendments naturally belong to the technical scope of the present invention.

In the embodiment described above, for instance, the penetration apertures 31 are each formed in a circular shape consisting of a plurality of circular arc sections 31*a*, but there are no particular limitations on the form and number thereof.

(Addition 1)

A press-fit connector having a press-fit pin which is inserted by pressure into a through hole of a circuit board, including: a press-fit section which holds the press-fit pin; and a connector section which can be installed on the press-fit section and which has a connection pin that can be connected to the press-fit pin when the connector section is installed on the press-fit section, wherein a penetration aperture for confirming buckling of the press-fit pin is provided in the press-fit section.

(Addition 2)

The press-fit connector according to Addition 1, wherein the penetration aperture is formed in a circular shape surrounding the press-fit pin.

(Addition 3)

The press-fit connector according to Addition 1 or 2, wherein the press-fit pin has a pressure insertion section which is inserted by pressure into the through hole of the circuit board, a connecting section for connecting the connection pin, and a fixing section to be fixed to a main body of the press-fit section.

(Addition 4)

The press-fit connector according to any one of Additions 1 to 3, wherein the press-fit section has a holding section which holds the connector section.

I claim:

1. A press-fit connector having a press-fit pin which is inserted by pressure into a through hole of a circuit board, comprising:

a press-fit section which has a first penetration aperture and which holds the press-fit pin; and a connector section which can be installed on the press-fit section and which has a connection pin that can be connected to the press-fit pin when the connector section is installed on the press-fit section, wherein a second penetration aperture for confirming buckling of the press-fit pin is provided surrounding the first penetration aperture in the press-fit section.

2. The press-fit connector according to claim 1, wherein the second penetration aperture is formed in a circular shape surrounding the press-fit pin.

3. The press-fit connector according to claim 1, wherein the press-fit pin has a pressure insertion section which is inserted by pressure into the through hole of the circuit board, a connecting section for connecting the connection pin, and a fixing section to be fixed to a main body of the press-fit section.

4. The press-fit connector according to claim 1, wherein the press-fit section has a holding section which holds the connector section.

5. The press-fit connector according to claim 2, wherein the press-fit pin has a pressure insertion section which is inserted by pressure into the through hole of the circuit board, a connecting section for connecting the connection pin, and a fixing section to be fixed to a main body of the press-fit section.

6. The press-fit connector according to claim 2, wherein the press-fit section has a holding section which holds the connector section.

7. The press-fit connector according to claim 1, wherein, the first penetration aperture has an inner surface that holds the press-fit pin, the second penetration aperture is formed in a circular shape surrounding the press-fit pin and passing in a thickness direction about an outer periphery of the first penetration hole, the second penetration aperture is comprised of a plurality of arcuate-shaped apertures that together are centered on the first penetration hole and surround the outer periphery of the first penetration hole, each arcuate-shaped aperture being separate from and spaced apart from two adjacent arcuate-shaped apertures and from the first penetration aperture, each arcuate-shaped aperture defining a circular arc section in plan view, and presence and absence of buckling of the press-fit pin is observable visually via the second penetration aperture from an upper surface side of the press-fit section.

8. The press-fit connector according to claim 1, wherein, the first penetration aperture has an inner surface that holds the press-fit pin, the second penetration aperture is formed by plural adjacent arcuate-shaped apertures that together are centered on the first penetration hole and surround an outer periphery of the penetration hole, and presence and absence of buckling of the press-fit pin is observable visually via the second penetration aperture from an upper surface side of the press-fit section.

9. The press-fit connector according to claim 1, wherein, the first penetration aperture has an inner surface that holds the press-fit pin in a first longitudinal direction, the second penetration aperture is formed by plural adjacent arcuate-shaped apertures that surround an outer periphery of the penetration hole, and presence and absence of buckling of the press-fit pin is observable visually, from an upper surface side of the press-fit section, via one of the arcuate-shaped apertures that is located in the first longitudinal direction.

* * * * *